US010093402B2

(12) United States Patent
Korneliussen et al.

(10) Patent No.: US 10,093,402 B2
(45) Date of Patent: Oct. 9, 2018

(54) SYSTEM FOR SUBSEA OPERATIONS

(71) Applicant: ARGUS REMOTE SYSTEM AS, Laksevag (NO)

(72) Inventors: Frode Korneliussen, Bergen (NO); Jan Bryn, Laddefjord (NO)

(73) Assignee: ARGUS REMOTE SYSTEMS AS, Laksevag (NO)

( * ) Notice: Subject to any disclaimer, the term of this patent is extended or adjusted under 35 U.S.C. 154(b) by 0 days.

(21) Appl. No.: 14/910,164

(22) PCT Filed: Jul. 29, 2014

(86) PCT No.: PCT/NO2014/050133
§ 371 (c)(1),
(2) Date: Feb. 4, 2016

(87) PCT Pub. No.: WO2015/020529
PCT Pub. Date: Feb. 12, 2015

(65) Prior Publication Data

US 2016/0176486 A1 Jun. 23, 2016

(30) Foreign Application Priority Data

Aug. 5, 2013 (NO) ..... 20131065
Nov. 25, 2013 (NO) ..... 20131562

(51) Int. Cl.
*B63G 8/00* (2006.01)

(52) U.S. Cl.
CPC ..... *B63G 8/001* (2013.01); *B63G 2008/005* (2013.01); *B63G 2008/008* (2013.01)

(58) Field of Classification Search
CPC ..... B63G 8/001; B63G 2008/005; B63G 2008/008; B63C 1/12
See application file for complete search history.

(56) References Cited

U.S. PATENT DOCUMENTS 4,721,055 A * 1/1988 Pado ..... B63C 11/52 114/330
6,167,831 B1 * 1/2001 Watt ..... B63G 8/001 114/245
6,260,504 B1 * 7/2001 Moles ..... B63B 27/36 114/312

OTHER PUBLICATIONS

International Search Report PCT/NO2014/050133 dated Nov. 5, 2014.

(Continued)

*Primary Examiner* — Anthony D Wiest
(74) *Attorney, Agent, or Firm* — McDermott Will & Emery LLP

(57) ABSTRACT

A system for subsea operation is described, comprising a free swimming, submersible garage and docking station (10,10'), and also an associated free swimming ROV (50), where the garage and docking station (10,10') comprises a framework (14) arranged to function as a garage (40) or docking (40') for the free swimming ROV (50), and where the submersible garage and docking station (10,10') comprises at least equipment in the form of several thrusters (16,18) for operation in the vertical and horizontal directions, respectively, units and a steering system for positioning in the water, and also a winch (12) connected to said ROV (50) via a cable (34) for the transfer of electricity and signals. The framework (14) of the garage and docking station (10,10') is manufactured from a material with buoyancy, and where the buoyancy of the framework is determined by the weight of the equipment mounted in the framework (14), so that a neutral or approximately neutral buoyancy in the water is provided for the garage and docking station (10,10').

14 Claims, 3 Drawing Sheets

(56) References Cited

OTHER PUBLICATIONS

Product catalogue, "Saab Seaye Tiger & Lynx", Published Apr. 6, 2013, p. 2, 3 [Chassis] [Buoyancy]; p. 4 [Tiger & Lynx Deployment and Operation] Fig.
FUGRO catalogue "Seaeye Tiger" Published Mar. 28, 2014, p. 2 [Technical Specifications] Chassis type and buoyancy.

* cited by examiner

SYSTEM FOR SUBSEA OPERATIONS

This application is the U.S. National Phase of PCT/NO2014/050133 filed Jul. 29, 2014, which claims priority to Norway Patent Application No. 20131065 filed Aug. 5, 2013, and Norway Patent Application No. 20131562 filed Nov. 25, 2013. The subject matter of each is incorporated herein by reference in entirety.

The present invention relates to a system for subsea operations, comprising a free swimming, submersible garage and docking station, and also an associated free swimming ROV, where the garage and docking station comprises a framework arranged to function as a garage or docking for the free swimming ROV and where the submersible garage and docking station comprises at least equipment in the form of several thrusters for operation in the vertical and horizontal directions, respectively, units and steering system for positioning in the water, and also a winch connected to said ROV via a cable for the transfer of electricity and signals.

The invention relates in more detail to a remotely operated, submersible unit, such as a TMSROV, Tether Management System ROV. Todays TMS (Tether Management System) is a unit with an underwater winch that feeds a cable in and out according to what the ROV needs. Known Tether Management Systems can, in some cases, be equipped with thrusters to be able to keep them in position in strong currents during launching and collecting. A tether is a thin cable mainly for signals and electricity.

TMSROV can have the same characteristics as an ROV, i.e. it can swim against the current and navigate to the position it searches. Traditionally a TMS is negative, but the solution according to the invention will preferentially be neutral, or for that matter, slightly positive or slightly negative, such as an ROV. It can be equipped with a camera, light, sonar, an altimeter, a depth gauge, HPR transponder, etc.

The TMSROV according to the invention will make the operations inside structures safer with regard to complex operations and will minimise the risks of getting stuck. The TMSROV will be ideal to carry sensors that the ROV shall swim out to place inside structures and the like.

Traditionally, a TMS is a stationary unit submersed in water or it moves with the ship suspended in a lifting cable. The background for the solution according to the invention is that where there are constructions or infra structures on the ocean bed this could lead to an increased safety in operations in such areas. It will be possible to steer it into position such that the ROV can swim out and carry out the task from the optimal position for the job and it will be able to hold the winch in the optimal direction towards the ROV so that the reeling in of the winch on the TMS uses the least possible force on the reeling in. It will also minimise or remove the need for a heave compensated winch on the surface vessel. The ROV can swim up in the water column and with the help of a slack umbilical, the ROV can dock in the TMS/garage without being influenced by the movements of the vessel.

With operations at great depths, for example 3000 m and deeper, the weight of the lifting cable is part of the setting of limitations on the operation and the surface equipment (LARS) becomes very large and heavy. With a neutral TMSROV this will not be a problem as it is neutral in the sea compared with the traditional TMS that can weigh 1-3 tonnes in the sea and which in turn requires a powerful lifting cable.

One object of the invention consists of providing a solution that will be able to lead to greater safety for operations in such areas.

Another object of the invention comprises being able to guide the TMSROV into position so that the ROV can swim out and carry out the work from the TMS in the best possible way, in this way making available optimal positions for the job such that it will be able to hold the winch in the optimal direction towards the ROV so the reeling in on a winch on the TMS uses the least possible power for the reeling in.

A further object is to reduce or remove the need for surface equipment with a heave compensated winch (LARS).

Buoyancy is an upwardly directed force that acts on a body submersed or partly submersed in a liquid. The buoyancy is as large as the weight of the amount of liquid the body displaces. If a body has a lower mass density than the liquid it displaces the buoyancy will make the body float in the liquid. The weight of the displaced liquid is directly proportional to the volume of the displaced liquid (in particular, if the surrounding liquid has a uniform density). Therefore, the body with the largest volume among equally large bodies will have the largest buoyancy.

Contrary to a submarine, the invention is basically not intended for continuous regulation of the buoyancy, but is constructed and adapted dependent on mounted equipment so that the buoyancy is in the main neutral or for that matter slightly positive or slightly negative. However, it shall not be ruled out that the buoyancy can also be regulated during use.

The above mentioned objects are reached with a system for subsea operations, comprising a free swimming, submersible garage and docking station, and also an associated free swimming ROV, where the garage and docking station comprises a framework arranged to function as a garage or docking for the free swimming ROV, and where the submersible garage and docking station comprises at least equipment in the form of several thrusters for operation in horizontal and vertical directions, respectively, units and a guiding system for positioning in the water, and also a winch connected with said ROV via a cable for the transfer of electricity and signals, characterised in that the framework of the garage and docking station is manufactured from a material having a buoyancy and where the buoyancy of the framework is determined dependent on the weight of the equipment mounted in the framework, so that a neutral or approximately neutral buoyancy in the water is provided for the garage and docking station.

Alternative embodiments are given in the dependent claims.

The framework of the garage and docking station can be manufactured from a composite material having a positive buoyancy. Furthermore, the garage and docking station can be equipped with removable weights, such as lead weights, to adjust the buoyancy in the water.

The submersible garage and docking station can be equipped with a cable that runs up to the surface for transfer of electricity and signals.

To regulate the desired distance to the ocean bed in real time, the garage and docking station can comprise equipment in the form of a number of sensors that are chosen from the group comprising; depth sensors, altimeters, differential depth gauges, pressure gauges and HPR, and at the same time to compensate for sideways movement due to the current, a number of sensors that are chosen from the group comprising: North seeking gyro, HPR, Doppler and INS.

Said weights can be arranged to be removed to compensate for the weight of additional equipment, or be added on when the additional equipment is removed. The weights can be fastened to a lower part of the framework.

The garage for the ROV can be provided in a lower area of the framework where the garage can have at least one garage opening and also a parking deck for said ROV.

Said ROV is preferably neutral or has an approximately neutral buoyancy in the water.

In one embodiment said ROV can be fastened suspended to the underside of the garage and docking station. Furthermore, the garage and docking station can be equipped as an ROV and be arranged to carry out the same or approximately the same tasks as an ROV.

The garage and the docking station can also be arranged to swim after the free swimming ROV, for the monitoring of the work of said ROV or to assist in the work.

In a further embodiment the garage and docking station can encompass, on the underside, a lifting hook or a fastening point, where a subsea structure or equipment can be suspended from, whereby the garage and docking station can be arranged to guide said structure or equipment to a given place on the ocean bed, and said ROV is arranged to swim after and assist in the placing of the structure or equipment on the sea bed.

The invention shall now be described in more detail with the help of the enclosed figures.

Figure 1:
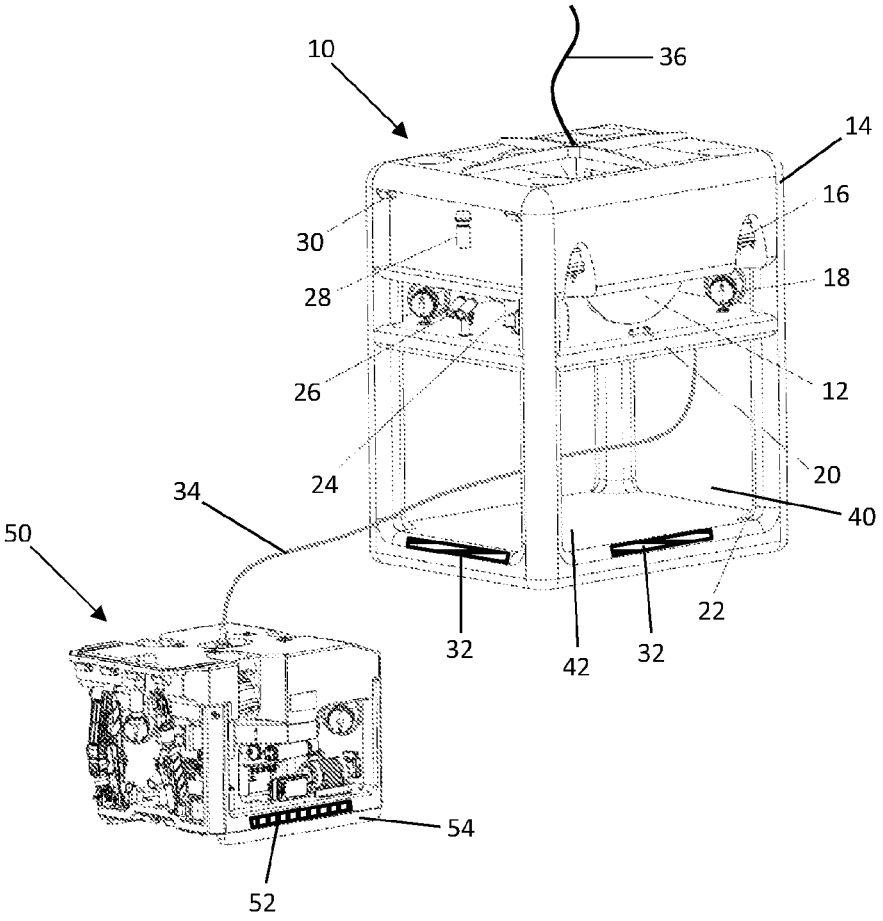
FIG. 1 shows an embodiment of a submersible garage and docking station (TMS) connected to an ROV.

The TMSROV according to the invention comprises a submersible garage and docking station 10 (TMS) that is equipped with a guiding system and control system as an ROV, and which comprises an ROV 50. The TMS can swim and be operated as an ROV, and can be compared to a swimming winch. For that reason, the submersible garage and docking station 10 can readily comprise a rectangular frame 14 that is equipped with thrusters in the form of, for example, motors with propellers. The thrusters can be placed in each corner of the frame 14, and can comprise a motor 16 for vertical movement in the water and a motor 18 for horizontal movement in the water. With vertical and horizontal movement it must be understood that this can also comprise a combination of said directions. A cable 36 for electricity and signals can run from a surface vessel (not shown) down to the submersible garage and docking station 10.

The submersible garage and docking station (TMS) 10 further comprises, preferably in the lower part of the frame 14, a garage 40 in which the ROV 50 can park. To simplify the driving in and out of the ROV from the garage, the garage 40 is preferentially open, either in one, two, three or four directions. Thus the garage 40 has at least one garage opening and parking deck 42. For a steady parking on the parking deck 42 the ROV can be equipped with an undercarriage with parking runners 54.

Furthermore, the submersible garage and docking station can be equipped with a depth sensor 20, an altimeter 22, a gyro 24, a camera 26, sonar 28, light 30 and also other required or necessary equipment.

The motors 16,18 with propellers will guide the submersible garage and docking station 10 into position and it will then stay in this position during the execution of a task. The ROV 50 can either swim out at a desired position or the submersible garage and docking station follows the ROV in the optimal position for the operation.

The submersible garage and docking station 10 can have all the connections that an ROV has. This means that it can be configured as an ROV, but it has also a winch 12 built into the garage. It feeds out and reels in a cable 34 to the ROV according to need. The cable 34 preferably transfers electricity and signals. The submersible garage and docking station 10 can also comprise the corresponding equipment and tools of an ROV so that it can carry out corresponding tasks. If the ROV is out of operation, the TMS 10 can continue the job while the ROV is disconnected and being repaired, which results in a redundant system.

The surface system can be comprised of LARS, a control container and workshop.

The submersible garage and docking station 10, and possibly the ROV, are equipped at all times with the sensors the task at hand requires. With its flexibility, it can be equipped with a sensor package corresponding to today's ROV.

The software that the sensors have as a standard can be connected together with the control system of the ROV and this gives much flexibility and confidence with complex situations near installations.

The sensors that can be used to position the submersible garage and docking station, with or without the ROV, in the vertical plane are a depth sensor, an altimeter, a differential pressure gauge and HPR. In the horizontal plane a north seeking gyro, HPR, Doppler and INS can be used.

The control system of the TMSROV is connected with the sensors and data that give a very high resolution on the vertical and horizontal positions and can give a very good resolution on a station keeping DP.

The submersible garage and docking station 10 with the ROV 50 parked in the garage, can be set out with LARS as if it was an ordinary ROV operation, but when the TMSROV is loose it will swim down to the depth the ROV survey/operation shall commence from.

The submersible garage and docking station can swim after the ROV and be used to observe the work that is being done.

With the bringing in of the TMSROV it can go into position with a slack cable to the surface and will then not be influenced by heave from the vessel.

Then the docking takes place according to the same principle as standard TMS/ROV operations.

An essential aspect of the invention is that a TMSROV shall preferably be neutral in the water, i.e. have an approximately neutral buoyancy and be in equilibrium. This will also be the case for a separate garage and docking station 10 and ROV 50. For that reason both the submersible garage and docking station and ROV can comprise means that provide respective parts, both on their own and together, neutral buoyancy so that the buoyancy is as large as the weight of the mass the liquid parts displaces. The submersible garage and docking station can be constructed so that it is neutral or that an extra buoyancy (payload) can be taken into account, but the ROV can be neutral. However, the ROV can also be constructed so that an extra buoyancy is taken into account. To regulate the buoyancy, weights 32,52, in the form of, for example, lead weights, can be fastened to the submersible garage and docking station and the ROV so that these have the required buoyancy.

The weights 32,52 can be removed to compensate for the weight of additional equipment, or be removed when the additional equipment is removed. The weights 32, 52 are shown illustratively in FIGS. 1 and 2, and can in a sense be placed anywhere in respective units. However, for considerations of the point of gravity, it is advantageous to place the weight as low as possible. It is also possible to use other forms of weights/regulation of the buoyancy.

A further essential aspect is that the garage and docking station 10 is manufactured from a material which basically has a positive buoyancy. Which material that shall be used or how much buoyancy that shall be provided will be dependent on the equipment that shall be mounted onto the garage and docking station 10. Therefore, it will be natural that the design must be ready, i.e., in particular the weight of the equipment, so that it can be estimated how much buoyancy the garage and docking station 10 shall have when constructed.

Figure 2:
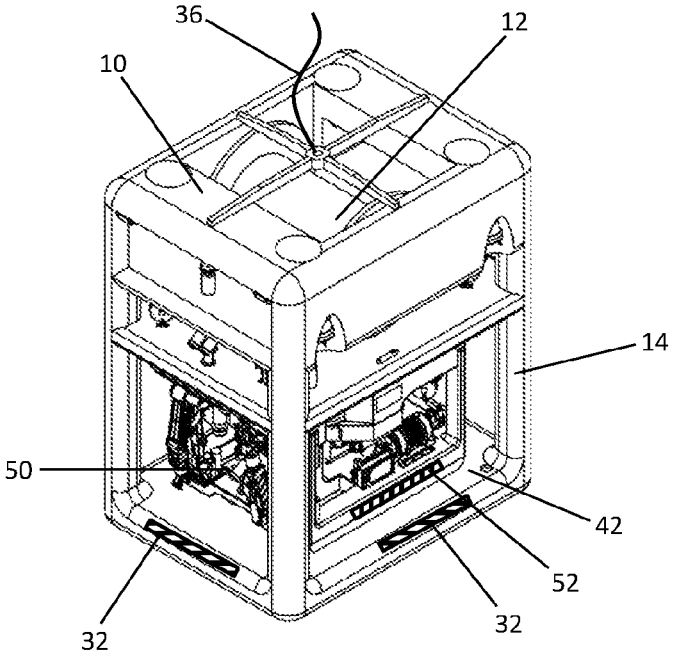
FIG. 2 shows the ROV parked in the submersible garage and docking station (TMS).
Figure 3:
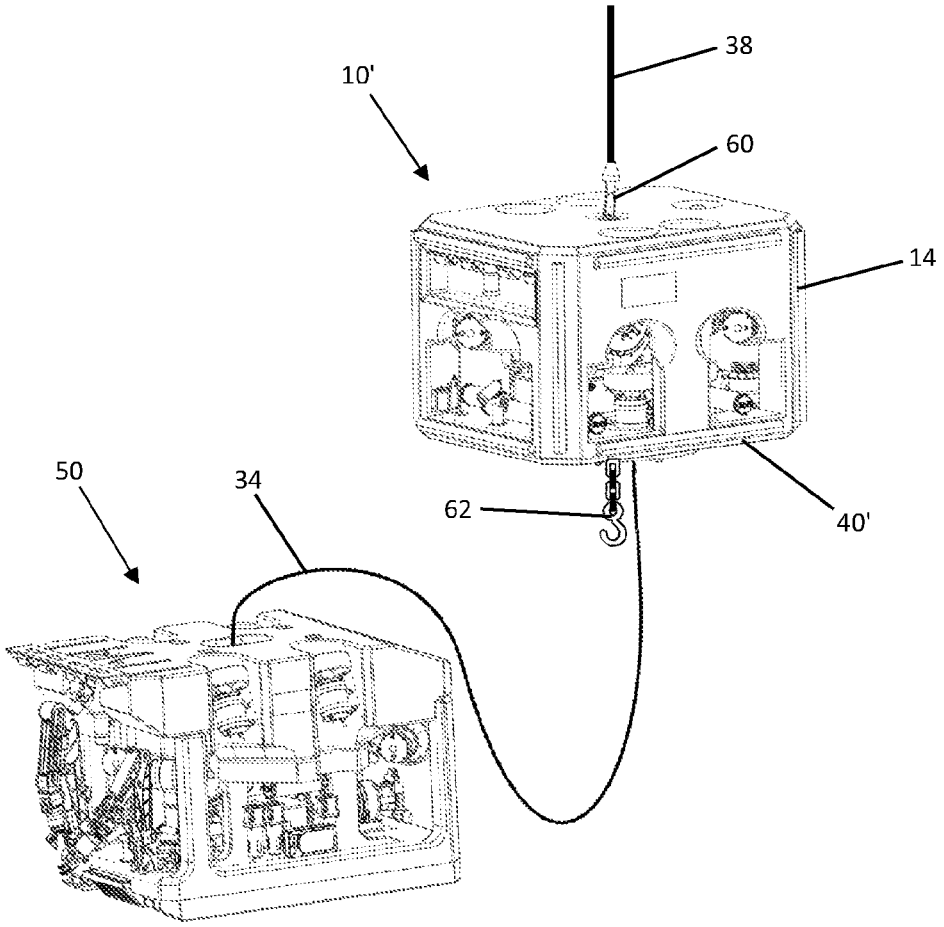
FIG. 3 shows a top hat version of a submersible garage and docking station (TMS connected to an ROV).

The submersible garage and docking station 10 can basically have two versions, either as a garage as described, as shown in FIGS. 1 and 2 and which one drives in and parks, or it can be as a top hat on which one docks at the top or under the submersible garage and docking station, such as shown in FIG. 3. The buoyancy of the TMSROV can, as mentioned, be estimated so that it is positive, that is one can have, for example, from 10 to, for example, 100 kg lead weights attached. When one attaches the equipment one removes lead corresponding to the buoyancy (weight) of the equipment. One will often operate the equipment positively 1-10 kg (this is a little floating). The advantage of operating slightly positively is because one must then force down against the bottom and the propeller stream then goes from the thrusters up and one avoids stirring up the bottom sediment which leads to poor visibility.

The embodiment of an ROV operation with a TMSROV will be carried out in the same way and according to the procedures as standard ROV operations. The difference is that the weather window is larger and one eliminates use of a heave compensated winch, as a TMSROV can swim vertically and the cable from the surface becomes slack so that it is not influenced by the movement of the vessel.

The TMSROV can also be used to observe operations carried out by an ROV, as it is equipped with a camera, sonar, light, etc. It can also follow an ROV in a more flexible way than previously where it followed the vessel. This opens for new possibilities within subsea operations.

It shall be pointed out that in connection with survey the system can also function in a known way, i.e. with the use of a lifting cable to regulate the distance to the surface or the bottom. The vessel enters its position and the submersible garage and docking station TMS, possibly with an ROV, is lowered down to the desired depth, the winch on the vessel will then take over the regulation of the vertical position. When the vessel goes on a line, a possible current will try to pull the TMS off the line. The TMS control system will then hold the TMS in a horizontal position so that the line is maintained. When the speed of the vessel increases and the forces that act on the cable will lift the TMS, the winch will give way to hold the vertical position or it will be weighed down according to experience data.

When the TMS is used at greater depths a depressor can be used. The depressor will press down so that it counteracts the forces that will lift the cable at greater speed of the vessel. The depressor is a wing that presses down the equipment that is towed and can be especially relevant when the TMS is used independently of the ROV in survey mode.

The system can have an integrated control and survey system ICSS. An ICSS is used so that surveys can be carried out faster and be of a better quality than today's technology.

To carry out a survey, one can use survey sensors such as multi-ray weights, a side scan sonar, sonar, a sub-bottom profiler, a video camera, a laser camera, a still photo camera, etc.

FIG. 3 shows the Top Hat variant of the docking station 10'. This can be equipped in the same way as the embodiment described in connection with FIGS. 1 and 2, apart from it not having the garage space. The docking station 10' is connected in a corresponding way with the ROV 50 via the cable 34.

In a further embodiment, which for that matter can be relevant for both the variants shown in the figures but in particular the Top Hat variant 10', the garage and docking station 10,10' can be equipped with a stronger fastening hook 60 or the like connected to a powerful cable 38 that runs up to the surface vessel. The garage and docking station 10,10' can also be equipped on the underside with a lifting hook 62, here shown illustratively. The aim of this arrangement is to use the garage and docking station 10,10' for the setting out of subsea equipment and construction on the ocean bed. Because of the garage and docking station having an approximately neutral buoyancy, the lift will be many tonnes lighter. In addition, the garage and docking station 10,10' can guide and lead the structure or the equipment to a given location on the ocean bed. At the same time, the ROV 50 can swim after and assist in the placing of the structure or equipment on the ocean bed.

The invention claimed is:

1. System for subsea operations, comprising:

a free swimming, submersible garage and docking station, and an associated free swimming ROV, the garage and docking station comprises a framework arranged to function as a garage or docking for the free swimming ROV, and the submersible garage and docking station comprises at least equipment in the form of plural thrusters for operation in vertical and horizontal directions, respectively, and a winch connected to said ROV via a cable for transfer of electricity and signals, wherein the framework of the garage and docking station includes a material with buoyancy, and where the buoyancy of the framework is determined by the weight of the equipment mounted in the framework, to provide neutral or approximately neutral buoyancy in the water for the garage and docking station, and said submersible garage and docking station, and the associated ROV, are free swimming independent of a connection to a surface winch.

2. System according to claim 1, wherein the framework of the garage and docking station includes a composite material that has a positive buoyancy.

3. System according to claim 1, wherein the garage and docking station is equipped with removable weights to adjust the buoyancy in the water.

4. System according to claim 3, wherein the weights are removable to compensate for the weight of extra equipment, or can be mounted when the extra equipment is removed.

5. System according to claim 3, wherein the weights are fastened to a lower part of the framework.

6. System according to claim 3, wherein the removable weights are lead weights.

7. System according to claim 1, wherein the submersible garage and docking station is equipped with a cable that runs up to a surface, for transfer of electricity and signals.

8. System according to claim 1, wherein to regulate in real time required distance to the ocean bed, the garage and docking station comprises sensors that are chosen from a group comprising; a depth sensor, an altimeter, a differential depth meter, a pressure gauge and HPR, and to compensate at the same time for sideways movements due to the current, sensors that are chosen from a group comprising; a North seeking gyro, HPR, Doppler and INS.

9. System according to claim 1, wherein the garage is provided in a lower area of the framework, where the garage has at least one garage opening and a parking deck for said ROV.

10. System according to claim 1, wherein said ROV has a neutral or approximately neutral buoyancy in the water.

11. System according to claim 1, wherein said ROV is fastened to an underside of the garage and docking station.

12. System according to claim 1, wherein the garage and docking station is equipped as an ROV and arranged to carry out the same or approximately the same tasks as an ROV.

13. System according to claim 1, wherein the garage and docking station is arranged to swim after the free swimming ROV to monitor the work of said ROV or to assist in the work.

14. System according to claim 1, wherein the garage and docking station on an underside comprises a lifting hook or a fastening point, where a subsea structure or equipment can be suspended, whereby the garage and docking station is arranged to guide said structure or equipment to a given place on the ocean bed, and said ROV is arranged to swim after and assist in the placing of the structure or equipment on the ocean bed.

* * * * *